US005090697A

United States Patent [19]

Lee

[11] Patent Number: 5,090,697

[45] Date of Patent: Feb. 25, 1992

[54] RACKET FRAME STRINGING MACHINE

[75] Inventor: Min-Wei Lee, Kaohsiung, Taiwan

[73] Assignee: Poreex Industrial Co., Ltd., Taiwan

[21] Appl. No.: 673,569

[22] Filed: Mar. 22, 1991

[51] Int. Cl.[5] ..... A63B 51/14

[52] U.S. Cl. ..... 273/73 A

[58] Field of Search ..... 273/73 R, 73 A, 73 B

[56] References Cited

U.S. PATENT DOCUMENTS 4,846,474 7/1989 Chiang ..... 273/73 A

FOREIGN PATENT DOCUMENTS 0382652 8/1990 European Pat. Off. ..... 273/73 A

*Primary Examiner*—Edward M. Coven
*Assistant Examiner*—Raleigh W. Chiu
*Attorney, Agent, or Firm*—Browdy and Neimark

[57] ABSTRACT

The present invention discloses a novel racket frame stringing machine, which generally comprises a guiding plate having a front holding arm and a rear holding arm to fix a racket frame. A string holding mechanism is located between the front and rear holding arm for fast moving and clipping. The present invention is aimed to resolve the problem often seen in conventional types of stringing machine.

1 Claim, 5 Drawing Sheets

RACKET FRAME STRINGING MACHINE

BACKGROUND OF THE INVENTION

The present invention is related to racket stringing, particularly to the type having a clip mechanism to interlace a network of strings, used to strike a ball or shuttle-cock.

The conventional type of racket frame stringing machine 1 as shown in FIG. 1, which includes rectangular shape shallow disk 11 with a pair of guiding slots 111 formed on peripheral exterior wall 11 to substantially receive a pair of L-shaped members 12, so that bar 13 connected to the L-shaped members can be activated to move along said guiding slots, meanwhile string clip 14 can be further forced to move.

Although the conventional type of string machine can satisfy the basic need, it is subject to one or more of the following disadvantages:

1) When the direction of string is to be altered, the position of the string clip 14 and its associated L-shaped members and the bar shall be changed too;
2) The L-shaped members used to guide the string clip 14, do not have any fastening means, which results in improper stringing of the interlaced network;
3) Further, the string clip 14 is of a fixed height, while the racket has generally different thickness, that will limit the applicability of the machine.

SUMMARY OF THE INVENTION

The present invention utilizes a pair of string holder assembles D allocated to interlace a string network in both transversal and longitudinal directions as best shown in FIG. 3.

Each string holder assembly D is further slidedly secured on a guiding rail, and the position of each assembly D can be adjusted by turning an adjusting nut located below the guiding rail.

The primary objective of the present invention is to resolve the problems set forth above.

Other advantages and objectives of the present invention will be appreciated as the invention becomes better understood through the following description when considered in connection with the accompanying drawings.

DETAILED DESCRIPTION OF THE PREFERRED EMBODIMENT

Figure 1:
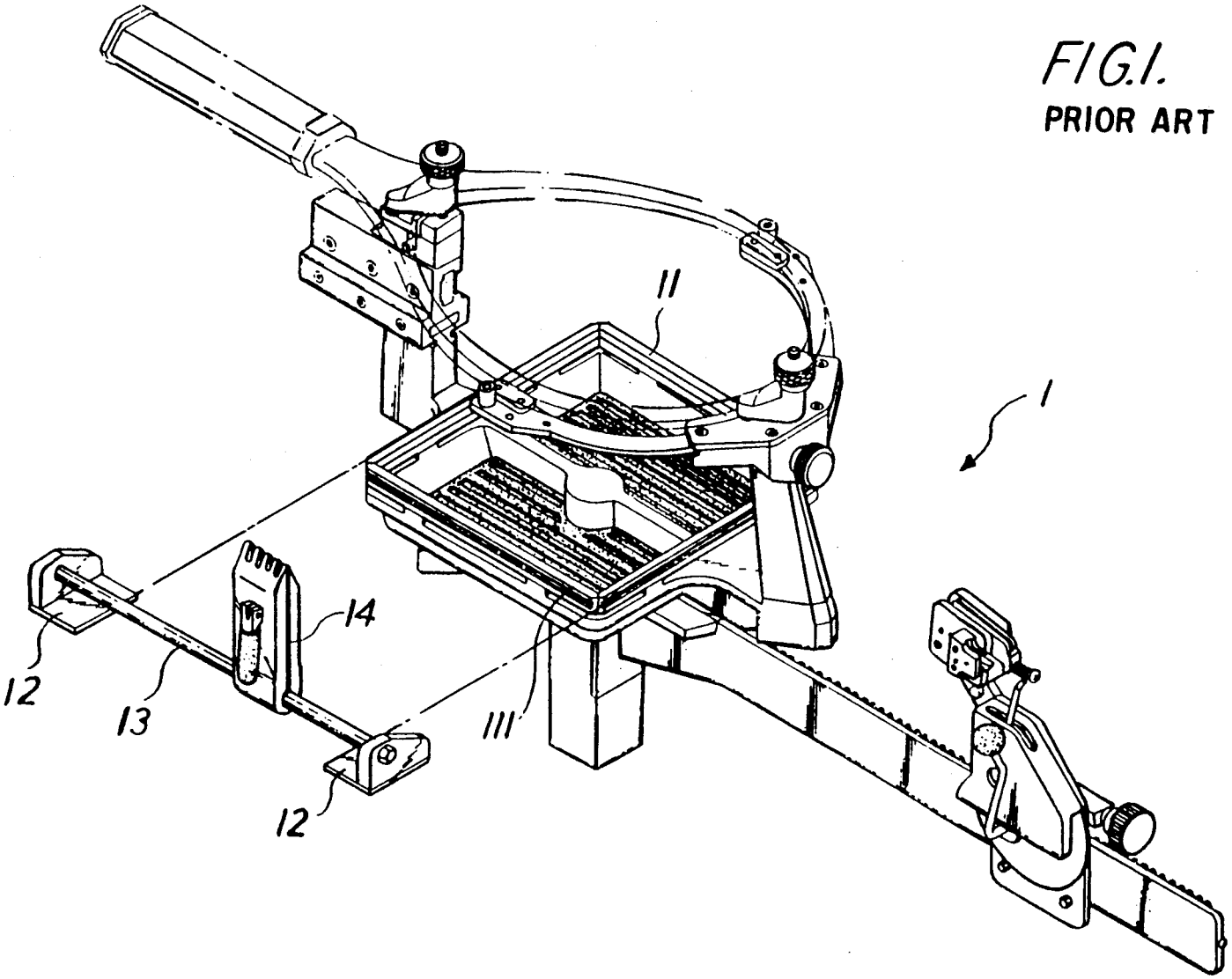
FIG. 1. PRIOR ART
FIG. 1 is a perspective view of prior art.
Figure 2:
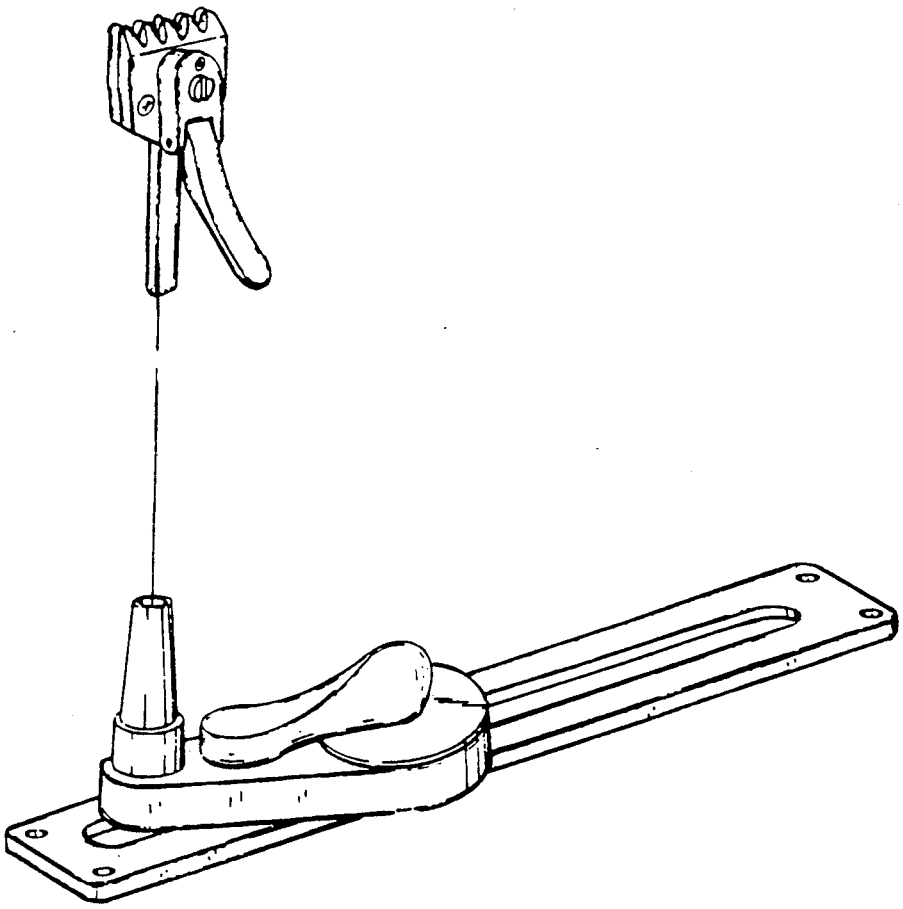
FIG. 2 shows the racket frame string machine fixture mechanism according to the present invention.
Figure 3:
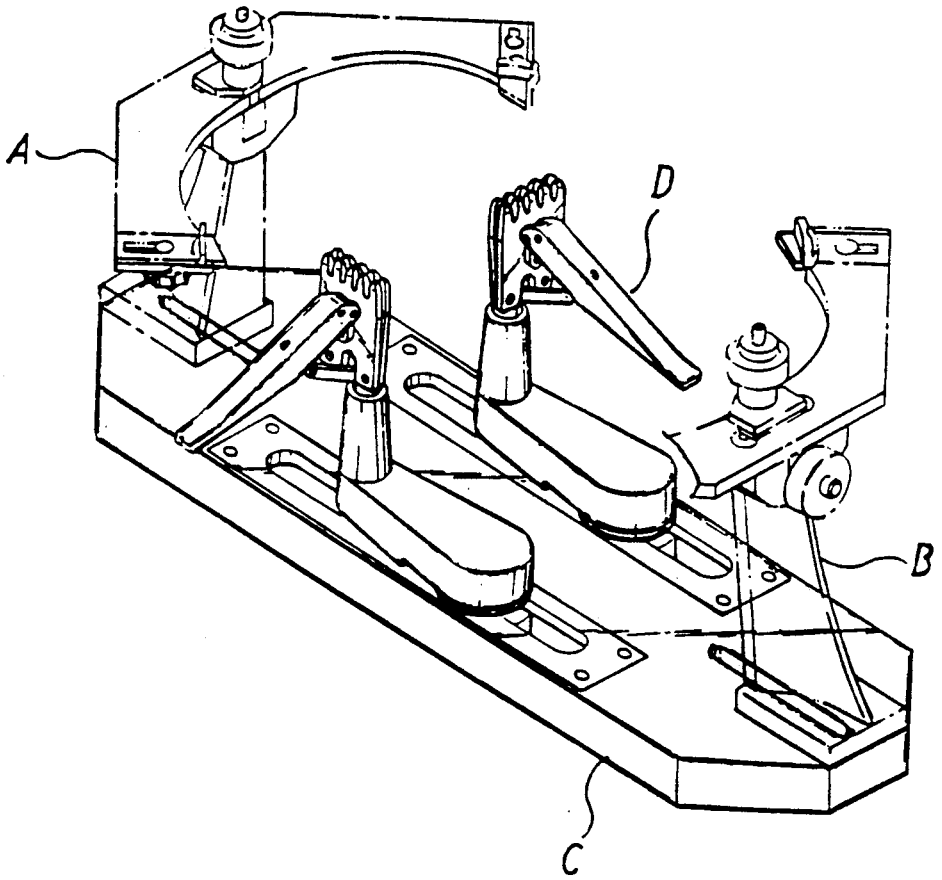
FIG. 3 is a perspective view according to the present invention.

With reference to FIG. 3, the present invention generally comprises a guiding plate C having front holding arm A and rear holding arm B to substantially fix a racket frame. A string holding mechanism D is located between the front and rear holding arms.

Figure 4:
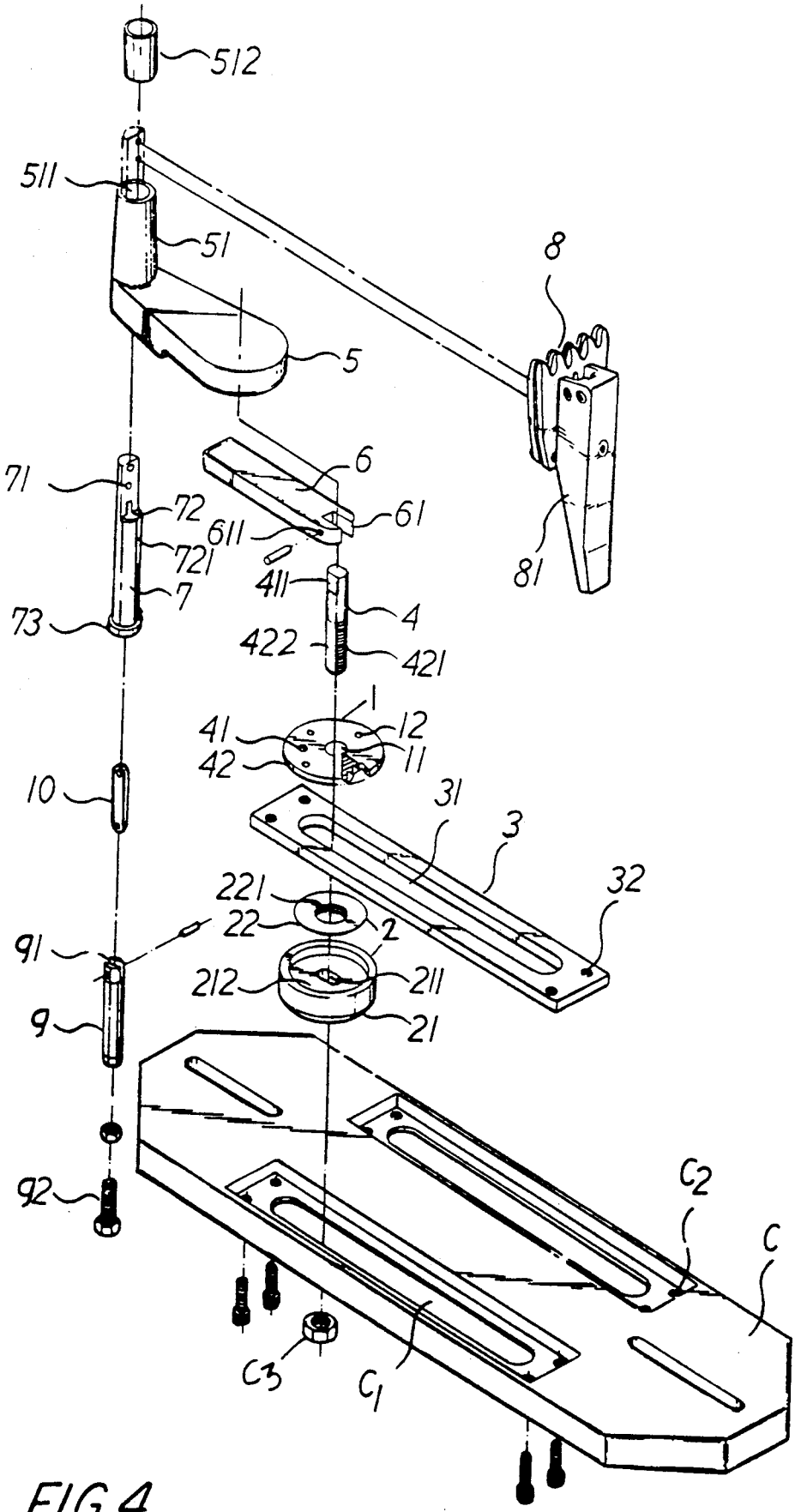
FIG. 4 is an explored view according to the present invention.
Figure 5:
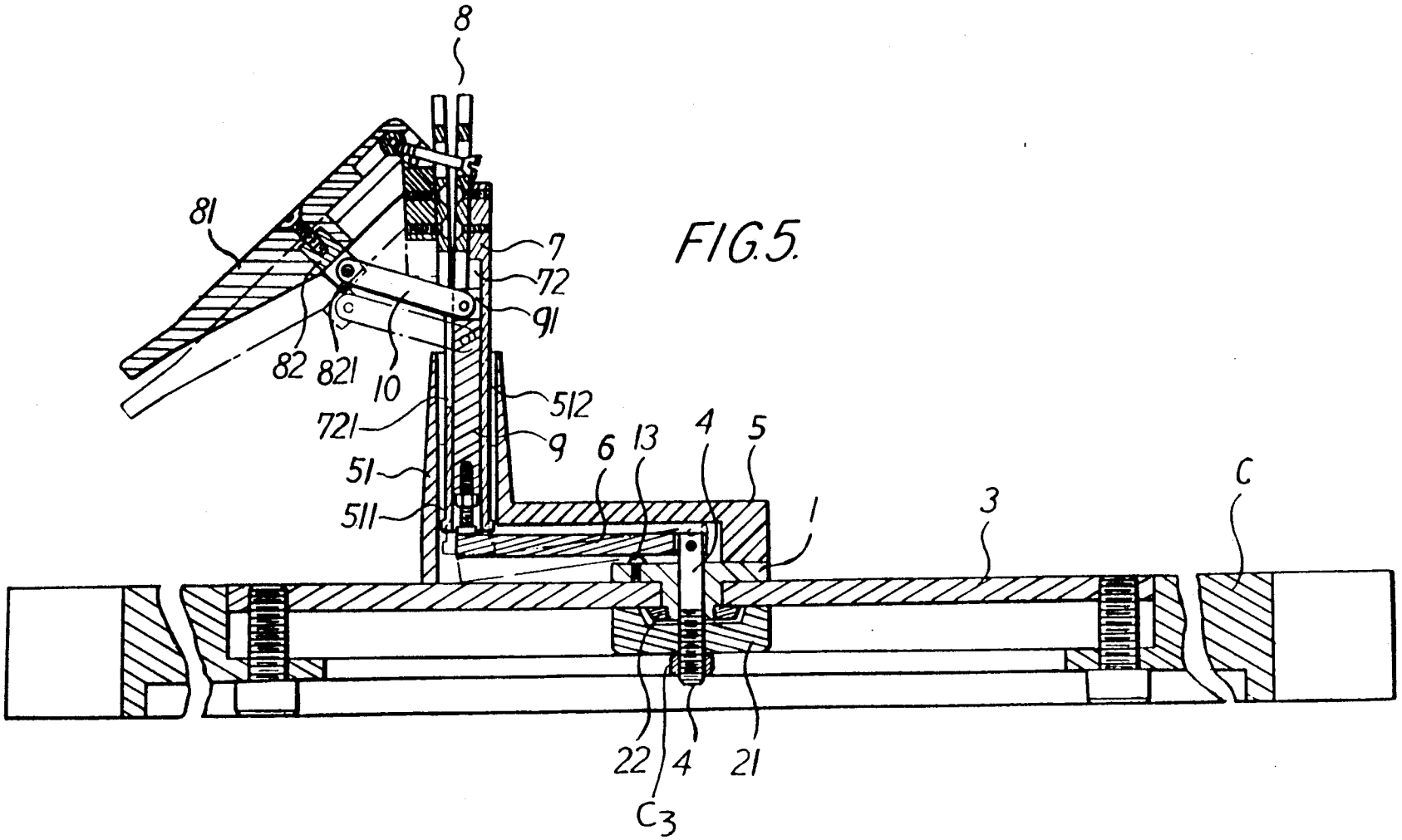
FIG. 5 is a front elevational view thereof.

Further referring to FIGS. 4 and 5, the string holding mechanism D has a disk member 1 in which a first through hole 11 is located in the center and a plurality of second through holes 12 are located radially to the center, while the disk member can be slidely received within guiding slot C1 of the guiding plate C.

The slide mechanism 2 has main annular member 21 and secondary annular member 22 inter-engageable to each other and further having common through holes 211 and 221 respectively. The secondary annular member 22 can be placed within recess 212 of main annular member 21.

Located between disk member 1 and slide mechanism 22 is a guiding rail 3 which is accommodated in the guiding slot C1. A plurality of threaded holes, typically four, are formed on the guiding rail 3 can be threadedly engaged by means of threaded bolts through holes formed on guiding slot C1 respectively.

A round fixing pole 4 is provided with flattened upper end 411 and lower end 422 while it also has threads 421 formed on its lower end 422. Flattened end 411 can be fitted into a notch 61 of arm 6 and pivotedly secured via pin hole 611. The lower end 422 is extended through disk member 1, guiding rail 3, slide mechanism 2 and guiding slot C1 for they have a common opening. Thereafter, an adjusting nut C3 is secured to threads 421.

Slide member 5 is roughly an oval shape which can accommodate arm 6 and through the pole 4, when moving along guiding rail 3. A cylindrical long projection 51 with inner through hole 511 is adapted to be connected with a string clip 8.

String clip holder 7 is extended through the long inner hole 511. Holder 7 has a cut away flat portion 71 as a base to secure the string clip 8. To assure an appropriate fit bushing 512 can be provided between projection 51 and clip holder 7.

A inner through hole 72 is formed in the string clip holder 7, which is open to the outside via a long slot 721 defined in a longitudinal direction. Further, a flange 73 is formed on lower end thereof.

A pushing rod 9 is mounted in through hole 72. Rod 9 has cut away recess 91 and an adjusting bolt 92 connected at the lower end thereof.

The string clip 8 is fixedly connected to string clip holder 7, and has a pressing member 81 and through which string to be interlaced can be firmly secured. Near the upper end of pressing member 81, a connecting block 82 fastened to member 8 has a pair of ears 821 projecting from the connecting block 82.

A link 10 has one end pivotally connected to the connecting block 82 at ears 821, while the other end is connected to the pushing rod through slot 91.

The present invention as disclosed above, therefore, provides a string clip which can be rotated in any angle or fixed or released easily. However, it is to be understood that numerous modification may be made without departing from the spirit and scope of this invention.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A racket frame stringing machine including a frame support having front and rear holding arms for holding a racket frame for interlacing a network of strings on said racket frame, said stringing machine comprising:

a guiding plate (C) having a guiding slot (C1);

a guiding rail (3) having a slot (31) mountable in said guiding slot (C1) with a plurality of threaded holes;

a disk member (1) slideable in said slot (31) of said guiding rail (3);

a slide mechanism (2) having a main annular member and a secondary annular member engaged in a recess of said main annular member;

said slide mechanism (2) slideable in said guiding slot (C1);

a round fixing pole (4) having a flattened upper end and a flattened lower end;

said flattened lower end being threaded;

said upper end having a notch;

a pivoting arm (6) pivotedly secured at a first end in said notch of said round fixing pole (4);

said disk member (1) and said slide mechanism (2) slideably engaged on opposite sides of said guiding rail (3) by extension of said round fixing pole (4) through a corresponding hole in said disk member, said slot (31) and a hole in said slide mechanism (2) and threadeningly engaging an adjusting nut (C3) to said lower end of said round fixing pole (4);

said guiding plate (C) engaged to said plurality of threaded holes of said guiding rail (3) by threaded bolts through said guiding plate (C);

an oval slide member (5) slideably engaged to said disk member (1) and housing said pivoting arm (6);

said oval slide member (5) having a vertical extension (51) having a hole at a top end communicating with a second end of said pivoting arm (6);

a spring clip holder (7) having an inner through hole at a lower end and a flat mounting surface at an upper end;

a push rod (9) having a notch at an upper end and an adjustable bolt at a lower end;

a link (10) having a first end pivotedly connected in said notch of said push rod (9);

said spring clip holder (7) slideably engaged in said vertical extension of said oval slide member (5) and abutting said second end of said pivoting arm;

said adjustable bolt of said push rod (9) adjustably abutting said second end of said pivoting arm through said through hole of said spring clip holder (7);

a strip clip (8) having a pressing member and mounted on said flat mounting surface;

said pressing member pivotedly connected to a second end of said link (10);

wherein said string clip (8) can be adjusted to move in a plurality of vertical and horizontal directions within said frame support to string said racket frame and said pressing member can be adjusted to create different pressures on said strings.

* * * * *